US007762407B2

(12) United States Patent
Speed et al.

(10) Patent No.: US 7,762,407 B2
(45) Date of Patent: Jul. 27, 2010

(54) DISPLAY DEVICE AND BLANK THEREFOR

(75) Inventors: Neil Hugh Forsyth Speed, Nottingham (GB); Alec Michael Simpson, Nottingham (GB)

(73) Assignee: Lighthouse Display International Limited (GB)

( * ) Notice: Subject to any disclaimer, the term of this patent is extended or adjusted under 35 U.S.C. 154(b) by 1318 days.

(21) Appl. No.: 10/523,672

(22) PCT Filed: Aug. 1, 2003

(86) PCT No.: PCT/GB03/03363

§ 371 (c)(1),
(2), (4) Date: Oct. 17, 2005

(87) PCT Pub. No.: WO2004/014197

PCT Pub. Date: Feb. 19, 2004

(65) Prior Publication Data

US 2006/0124565 A1 Jun. 15, 2006

(30) Foreign Application Priority Data

Aug. 9, 2002 (GB) ..... 0218529.6

(51) Int. Cl.
*A47G 29/00* (2006.01)

(52) U.S. Cl. ..... 211/72

(58) Field of Classification Search ..... 211/113, 211/72, 73, 52, 55, 71.01; 206/740, 741, 206/744, 745; 40/124, 124.4, 656; 220/503, 220/507, 555, 520

See application file for complete search history.

(56) References Cited

U.S. PATENT DOCUMENTS

| | | | | | |
|---|---|---|---|---|---|
| 768,007 | A | * | 8/1904 | Weissenstein | 131/239 |
| 1,683,098 | A | * | 9/1928 | Ridgway | 248/174 |
| 1,699,875 | A | * | 1/1929 | Burgess | 248/152 |
| 1,821,960 | A | * | 9/1931 | Brooks, Jr. | 206/750 |
| 1,894,902 | A | * | 1/1933 | Carmichael | 211/73 |
| 1,959,619 | A | * | 5/1934 | Ebert | 211/73 |
| 2,135,533 | A | * | 11/1938 | Ringler | 206/740 |
| 2,307,992 | A | * | 1/1943 | Calhoun et al. | 206/733 |
| 2,307,993 | A | * | 1/1943 | Calhoun et al. | 211/26 |
| 2,324,232 | A | * | 7/1943 | Pantalone | 211/73 |
| 2,340,148 | A | * | 1/1944 | Silberstein | 206/744 |
| 2,609,090 | A | * | 9/1952 | Tyrseck | 206/744 |
| 4,483,502 | A | | 11/1984 | Fast | |
| 4,546,943 | A | | 10/1985 | Fast | |

(Continued)

FOREIGN PATENT DOCUMENTS

AU 578222 B 11/1988

(Continued)

*Primary Examiner*—Jennifer E. Novosad
(74) *Attorney, Agent, or Firm*—Trexler, Bushnell, Giangiorgi, Blackstone & Marr, Ltd

(57) ABSTRACT

A display device which includes an elongate strip of sheet material having a plurality of product carrying pockets each pocket being provided with a pair of laterally spaced front sections in a plane substantially parallel to the plane of an adjacent rear section of the elongate strip, each front section being attached to the rear section at its upper edge respectively, by way of upper bridge portions, further attachment between a further section of the rear section and the front sections is provided by a lower bridge portion intermediate the front sections and which is attached adjacent the lower edges thereof.

17 Claims, 2 Drawing Sheets

U.S. PATENT DOCUMENTS

| | | | | |
|---|---|---|---|---|
| 4,570,805 | A * | 2/1986 | Smith | 211/149 |
| 4,890,809 | A | 1/1990 | Good | |
| 5,020,761 | A | 6/1991 | Good et al. | |
| 5,183,166 | A * | 2/1993 | Belokin et al. | 211/149 |
| 5,213,220 | A * | 5/1993 | McBride | 211/132.1 |
| 5,513,745 | A * | 5/1996 | Zoltan et al. | 206/741 |
| 5,542,634 | A | 8/1996 | Pomerantz | |
| 5,553,721 | A * | 9/1996 | Gebka | 211/59.1 |
| 5,908,119 | A * | 6/1999 | Kump et al. | 211/113 |
| 6,213,313 | B1 * | 4/2001 | Levy | 211/51 |
| 6,382,569 | B1 * | 5/2002 | Schattner et al. | 248/74.1 |
| 6,530,485 | B1 * | 3/2003 | Weber | 211/55 |
| 7,216,772 | B2 * | 5/2007 | Moss et al. | 211/72 |
| 2003/0106867 | A1 * | 6/2003 | Caterinacci | 211/40 |
| 2005/0224431 | A1 * | 10/2005 | Campello et al. | 211/52 |
| 2006/0151407 | A1 * | 7/2006 | Virvo | 211/72 |
| 2006/0273054 | A1 * | 12/2006 | Moss et al. | 211/72 |

FOREIGN PATENT DOCUMENTS

| | | | |
|---|---|---|---|
| FR | 2 532 536 | A | 3/1984 |
| GB | 394878 | A | 7/1933 |
| WO | WO 00/26109 | | 5/2000 |

* cited by examiner

DISPLAY DEVICE AND BLANK THEREFOR

Related/Priority Application

This application is a National Phase filing regarding International Application No. PCT/GB2003/003363 which relies upon British Application No. 0218529.6 for priority.

FIELD OF THE INVENTION

This invention relates to display devices and blanks for the same of a type similar to those known as strip merchandisers. Strip merchandisers, also known as clip-strips, generally comprise an elongate strip having means thereon to carry multiples of product which can be suspended on or from a shelf or other retail display device.

BACKGROUND OF THE INVENTION

Strip merchandisers are widely used throughout the retail trade to take advantage of cross-selling opportunities between products and to create impulse purchases without using valuable shelf space. They are also useful to display a plurality of discrete articles in a prominent manner using the least amount of available display area.

Examples of such strip merchandisers are described in U.S. Pat. Nos. 4,483,502 & 4,546,943.

As can be seen in the art, strip merchandisers are provided with a plurality of longitudinally spaced hooks upon which product may be hung. Many items are sold in packaging having a convenient tab in which a suitable hole or slot can be made enabling the products to be readily displayed on a strip merchandiser. Unfortunately this is not always possible or convenient, either the packaging size or shape does not easily take a punched hole or slot, as in cosmetics sachets for example, or the product does not usually have any additional packaging, as in a paperback book. It is possible to attach tabs having slots therein to each item. Tabs of this type are described in many Patent publications including WO00/26109; U.S. Pat. Nos. 5,542,634; 5,020,761; and U.S. Pat. No. 4,890,809 but these can have their own disadvantages. The adhesive on the tab may not always attach or remain attached to the product. For example the package may be a sachet which has been sealed by heat sealing or the like so that the edges of the sachet are no longer flat and do not readily adhere to the tab. In other cases, the adhesive may damage the product, for example the cover of a book. It will also be apparent to one skilled in the art that these tabs invariably are applied manually and the expense through added labour and material costs is not attractive. The current requirement from many retailers is for products to be delivered by the manufactures/wholesalers already attached to a strip merchandiser. If product is damage or detached from a strip then there is every chance that the whole strip or event the batch may be rejected.

It is one object of the present invention to provide a display device akin to a strip merchandiser whereby the disadvantages described above may be overcome.

SUMMARY OF THE INVENTION

According to one aspect of the present invention a display device comprises an elongate strip of sheet material having a plurality of product carrying pockets each pocket being provided with a pair of laterally spaced front sections in a plane substantially parallel to the plane of an adjacent rear section of the elongate strip, each front section being attached to said rear section of the elongate strip, at or adjacent an upper edge thereof, by means of an upper bridge portion, a further attachment between a further section of the elongate strip and the front portions is provided by at least one lower bridge intermediate the front portions and which is attached thereto at or adjacent the lower edges thereof and the pockets being arranged one above another so that the front sections of an upper pocket are in integral and coplanar attachment with the rear sections of a pocket immediately below.

It will be seen that products may be held in the space defined by at least the front and rear sections and the at least one lower bridge portion. For additional security and to prevent accidental removal of products from the pockets one or both of the front portions, may be provided with detent means to firmly engage the product when located in the pocket. Such detent means is preferably provided in both front portions and may each comprise a tab adapted to abut either side of the products. The tab is preferably integral with the front portion.

The upper and lower bridge portions are preferably integral with respective areas of the front and rear sections and may provided by part of the respective section thereof or in one embodiment are provided by such parts which extend therebetween substantially at right angles to the substantially parallel planes, which parts being defined by fold-lines adapted to allow the bridge portions to remain substantially at rights angle to the parallel planes at least during use.

The display device may be provided with any convenient number of pockets which may be arranged continuously in stepped arrangement as described above. For convenience the display device is preferably provided with means to enable the loaded display device to be folded at least once along its length so that the loaded display device may be conveniently packed in a suitable carton or other container for shipment. In one embodiment the stepped arrangement is interrupted by an intermediate flat section of elongate strip which flat section carries means to facilitate a fold. Such means to facilitate the fold may be provided by a score-line, perforations or any other convenient means. Where perforations are provided that strip may also be readily split so as to produce a series of shorter strips, which may suit a particular retailer or to remove a section of display device from which all the product has been purchased.

Preferably the display device is provided at its head with means to attach the display device to other display apparatus. Such means may be provided by a hole or slot or self-adhesive tape or by any other convenient means. Where the display device is capable of being split, further attachment means may be provided below the perforations in the intermediate flat section.

It is a particular advantage of the present invention that the display device may be manufactured from a single sheet of material which sheet is provided with a series of cuts and fold lines which form the various sections and portions of the pockets.

According to another aspect of the present invention a blank for a display device of the type having a plurality of product carrying pockets comprises an elongate sheet of suitable material having a pair of substantially parallel spaced lines of longitudinal cuts running substantially centrally along at least one section of the sheet material, a second pair of substantially parallel spaced lines of longitudinal cuts running one each intermediate the first pair of lines and a respective edge of the sheet, adjacent cuts in the first and second lines being joined by a connecting cut between the leading and of a respective cut in the second pair of lines and the trailing end of a respective cut in the first pair of lines so that each area of sheet between each respective pair of cuts in the first pair of lines and a respective nearest portion edge of the sheet defines a front section of a pocket, each area of sheet between each respective pair of cuts in the second pair of lines and a respective nearest portion edge of the sheet defines an upper bridge portion, a first region of each area of sheet between each pair of cuts in the first pair of lines adjacent and extending laterally from the respective connecting cuts defines a rear section of the pocket, and a second remaining region of each area of sheet between each pair of cuts in the first pair of lines defines a lower bridge portion.

Preferably a number of transverse fold lines, which may be score-lines or perforated or provided by any convenient means are provided at each end of each bridge portion to facilitate folding of the blank to form the pockets.

Each are defining a front portion may be provided with a cut defining a tab which may be folded to secure product when held in a pocket.

Each cut defining the tab may be any convenient shape such as a 'c' shape and may be provided with an appropriate fold line.

DESCRIPTION OF THE PREFERRED EMBODIMENTS

Figure 1:
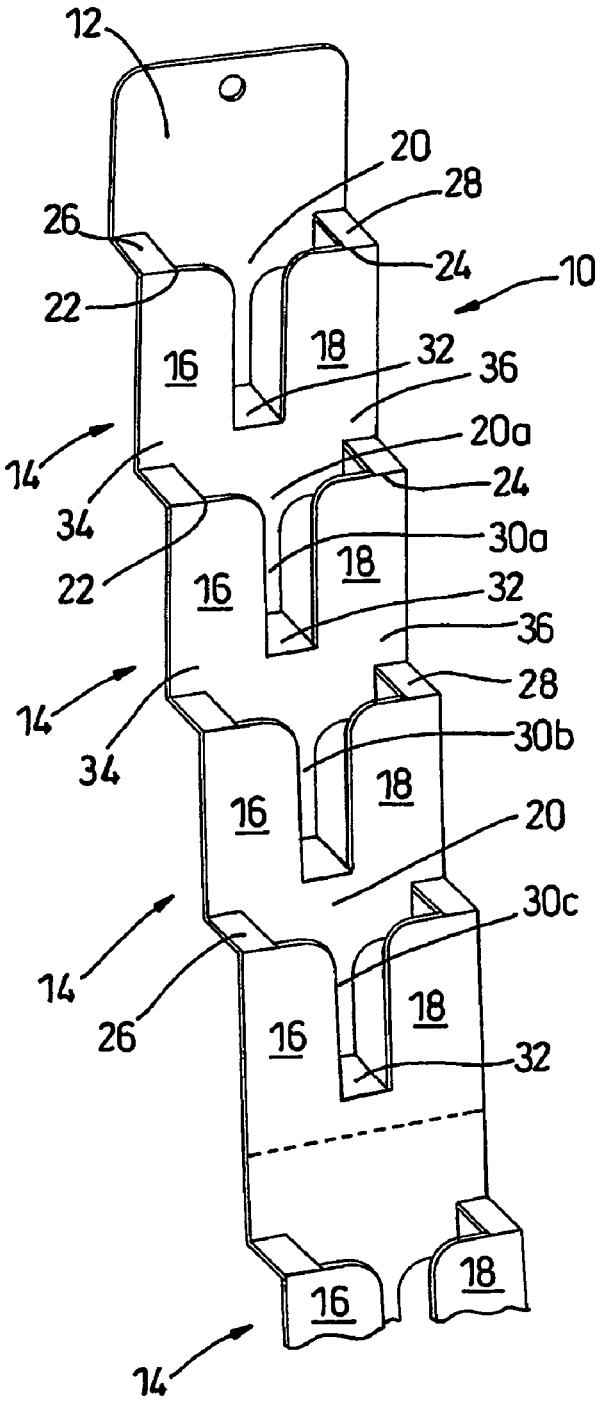
FIG. 1 is a perspective of a length of display device in accordance with a the present invention.
Figure 2:
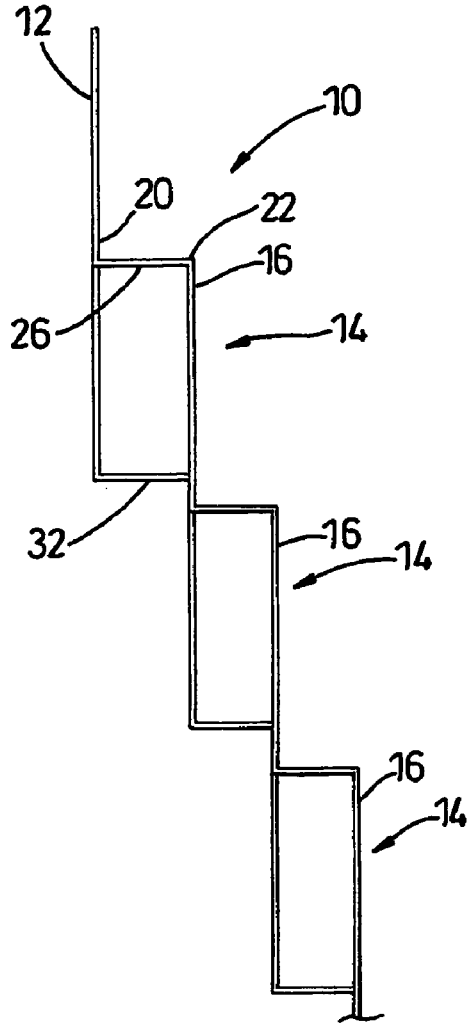
FIG. 2 is a side elevation of a section of the display device of FIG. 1.

Referring first to FIGS. 1 and 2 a display device 10 comprises an elongate strip 12 of sheet material having a plurality of product carrying pockets 14 each pocket 14 being provided with a pair of laterally spaced front sections 16, 18 in a plane substantially parallel to the plane of an adjacent rear section 20 of the elongate strip 12, each front section 16, 18 being attached to said rear section 20 at its upper edge 22, 24 respectively, by means of upper bridge portions 26, 28, further attachment between a further section 30 of the rear section 20 and the front sections 16, 18 is provided by a lower bridge portion 32 intermediate the front sections 16, 18 and which is attached adjacent the lower edges 34, 36 thereof. As can be seen in FIG. 2 the pockets 14*a*, 14*b*, 14*c* etc., are arranged one above another so that the front sections 16*a*, 18*a* of an upper pocket 14*a* are in integral and coplanar attachment with the rear sections 20*a*, 30*a* of the pocket 14*b* immediately below.

Figure 3:
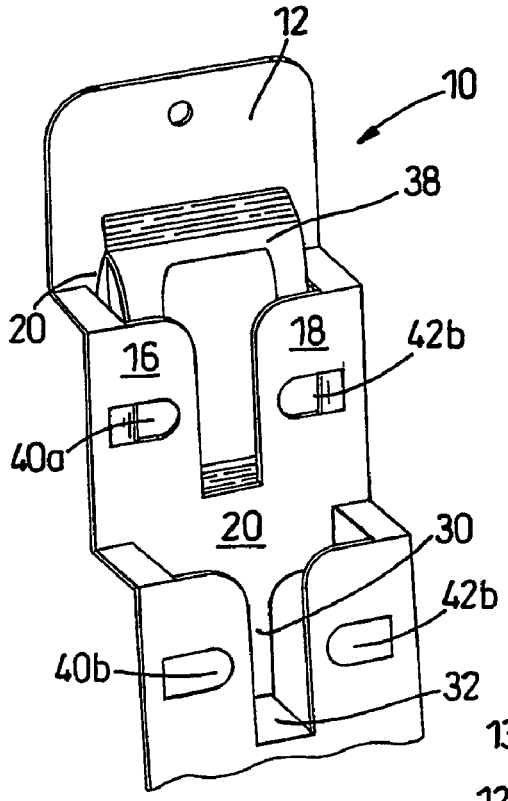
FIG. 3 is a perspective of a length of display device showing detent means and product.

It will be seen in FIGS. 1 and 2, and, in particular, in FIG. 3, that product 38 is held, in this embodiment, in the space defined by the front and rear sections 16, 18, 20, 30 and the lower bridge portion 32. As can be seen further in FIG. 3 the display device, for additional security and to prevent accidental removal of products, are provided with tabs 40*a*, 42*a*; 40*b*, 42*b*; etc. in each front portion to firmly engage the product when located in the pocket.

Figure 4:
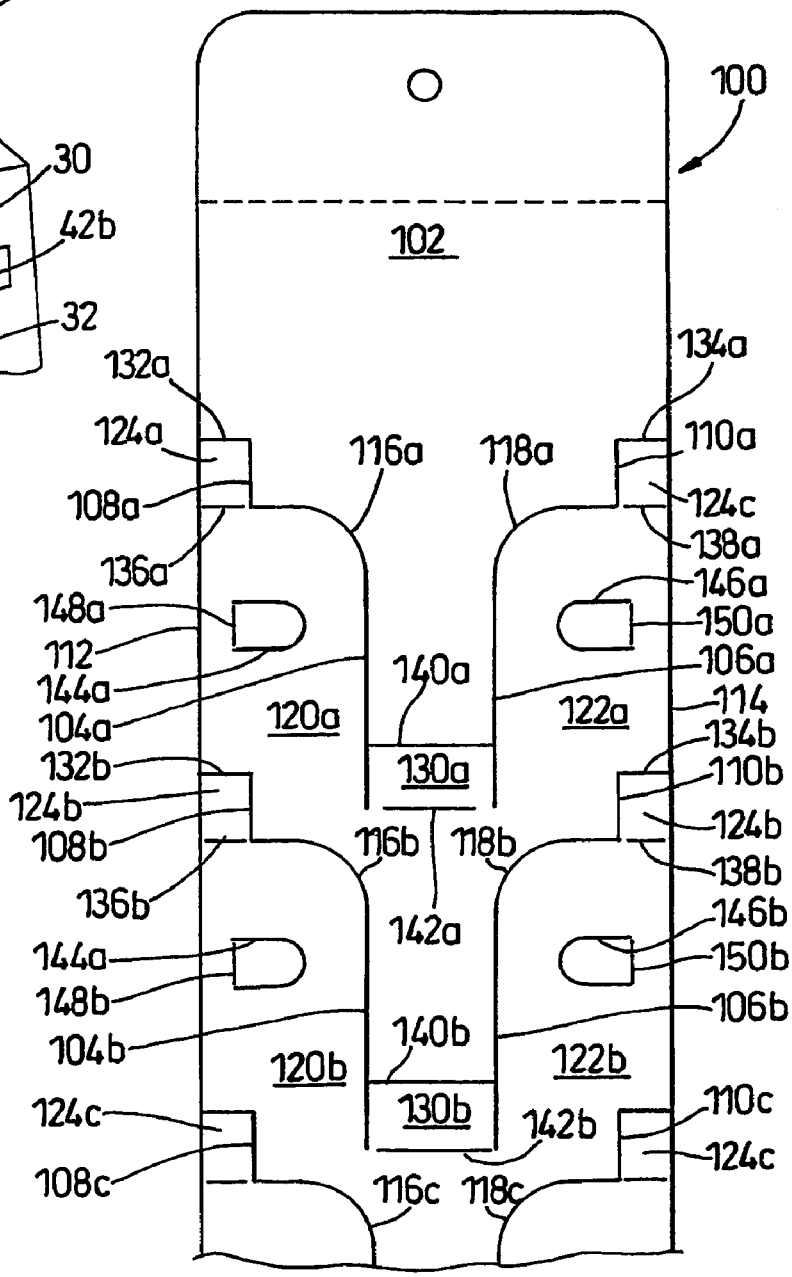
FIG. 4 is a plan of a length of display device in a flat condition.

In FIG. 4 a blank 100 for a display device of the type having a plurality of product carrying pockets has an elongate sheet 102 having a pair of substantially parallel spaced lines of longitudinal cuts 104*a*, 106*a*; 104*b*, 106*b*; etc. running substantially centrally along at least one section of the sheet material, a second pair of substantially parallel spaced lines of longitudinal cuts 108*a*, 110*a*; 108*b*, 110*b*; etc. running one each intermediate the first pair of lines and a respective edge 112, 114 of the sheet, adjacent cuts in the first and second lines being joined by a connecting cut 116*a*, 118*a*; 116*b*, 118*b*; etc. between the leading and of a respective cut in the second pair of lines and the trailing end of a respective cut in the first pair of lines so that each area of sheet between each respective pair of cuts in the first pair of lines and a respective nearest portion edge of the sheet defines a front section 120*a*, 122*a*; 120*b*, 122*b*; etc. of a pocket, each area of sheet between each respective pair of cuts in the second pair of lines and a respective nearest portion edge of the sheet defines an upper bridge portion 124*a*, 126*a*; 124*b*, 126*b*; etc. a first region of each area of sheet between each pair of cuts in the first pair of lines adjacent and extending laterally from the respective connecting cuts defines a rear section 128*a*; 128*b*; etc. of the pocket, and a second remaining region of each area of sheet between each pair of cuts in the first pair of lines defines a lower bridge portion 130*a*; 130*b*; etc.

A number of transverse score-lines 132*a*, 134*a*, 136*a*, 138*a*; 140*a*, 142*a*; 132*b*, 134*b*, 136*b*, 138*b*; 140*b*, 142*b*; etc. are provided at each end of each bridge portion 124*a*, 126*a*, 130*a*; etc. to facilitate folding of the blank to form the pockets.

In the embodiment illustrated each area defining a front portion is provided with a 'c' shape cut 144*a*, 146*a*; 144*b*, 146*b*; etc. defining tabs, having a fold line 148*a*, 150*a*; 148*b*, 150*b*; etc., which tabs may be folded to secure product when held in a pocket. See FIG. 3 for tabs in use.

The invention claimed is:

1. A display device comprising an elongate strip of sheet material having a plurality of product carrying pockets, each pocket being provided with a pair of laterally spaced front sections in a plane substantially parallel to a plane of an adjacent rear section of the elongate strip, each front section being attached to the rear section of the elongate strip, at or adjacent an upper edge of each front section, via an upper bridge portion, wherein the front sections are also attached to the elongate strip via at least one lower bridge located at or adjacent lower edges of the pockets, and the pockets being arranged one above another so that the front sections of an upper pocket are in integral and coplanar attachment with a rear section of a pocket immediately below.

2. A display device as in claim 1 wherein one or both of the front sections of each pocket is provided with a detent which is configured to engage the product when located in the pocket.

3. A display device as in claim 2 wherein a detent is provided in both front sections of each pocket, and each detent comprises a tab adapted to abut either side of the product.

4. A display device as in claim 3 wherein the tab is integral with the front section.

5. A display device as in claim 1 wherein the upper and lower bridge portions are integral with areas of the front and rear sections.

6. A display device as in claim 1 wherein the upper and lower bridge portions are integral with respective areas of the front and rear sections and are provided by parts which extend therebetween substantially at right angles to substantially parallel planes, said parts being defined by fold-lines adapted to allow the bridge portions to remain substantially at right angles to the parallel planes at least during use.

7. A display device as in claim 1 wherein there is provided a plurality of pockets arranged continuously in stepped arrangement.

8. A display device as in claim 7 wherein the stepped arrangement is interrupted by an intermediate flat section of elongate strip, wherein the flat section is configured to facilitate a fold.

9. A display device as in claim 1 wherein the display device is configured to be folded at least once along its length so that the display device may be packed in a carton or other container for shipment.

10. A display device as in claim 1 wherein the device is configured to attach to other display apparatus.

11. A display device as in claim 10 wherein a head of the display device comprises a hole or slot.

12. A display device as in claim 10 further comprising self-adhesive tape on a head of the display device.

13. A display device as in claim 1 wherein the display device is configured to be split, wherein the display device comprises at least one perforation.

14. A blank for a display device having a plurality of product carrying pockets comprising an elongate sheet of material having a pair of substantially parallel spaced lines of longitudinal cuts running substantially centrally along at least one section of the sheet material, a second pair of substantially parallel spaced lines of longitudinal cuts running intermediate the first pair of lines and a respective edge of the sheet, adjacent cuts in the first and second lines being joined by a connecting cut thereby defining a front section of a pocket, each area of sheet between each respective pair of cuts in the second pair of lines and a respective nearest edge of the sheet defines an upper bridge portion, a first region of each area of sheet between each pair of cuts in the first pair of lines adjacent and extending laterally from the respective connecting cuts defines a rear section of the pocket, and a second remaining region of each area of sheet between each pair of cuts in the first pair of lines defines a lower bridge portion.

15. A blank for a display device as in claim 14 wherein there is provided a number of transverse fold lines, wherein each end of each bridge portion is configured to facilitate folding of the blank to form the pockets.

16. A blank for a display device as in claim 14 wherein each line defining a front portion is provided with a cut defining a tab which is foldable to secure product when held in a pocket.

17. A blank for a display device as in claim 16 wherein each cut defining the tab has a shape 'c' shape and is provided with a fold line.

* * * * *